US008075963B2

(12) United States Patent
Martin

(10) Patent No.: US 8,075,963 B2
(45) Date of Patent: Dec. 13, 2011

(54) MATERIAL FOR FORMING IMAGES BY INKJET PRINTING

(75) Inventor: Didier J. Martin, Givry (FR)

(73) Assignee: Eastman Kodak Company, Rochester, NY (US)

( * ) Notice: Subject to any disclaimer, the term of this patent is extended or adjusted under 35 U.S.C. 154(b) by 1559 days.

(21) Appl. No.: 11/349,374

(22) Filed: Feb. 7, 2006

(65) Prior Publication Data

US 2007/0184217 A1 Aug. 9, 2007

(51) Int. Cl.
*B41M 5/50* (2006.01)

(52) U.S. Cl. ..... 428/32.34; 428/32.25; 428/32.38

(58) Field of Classification Search ..... None
See application file for complete search history.

(56) References Cited

U.S. PATENT DOCUMENTS

| | | | | |
|---|---|---|---|---|
| 4,474,847 | A * | 10/1984 | Schroder et al. | 428/32.35 |
| 4,898,810 | A | 2/1990 | Eggert et al. | |
| 5,429,860 | A * | 7/1995 | Held et al. | 428/32.3 |
| 5,738,932 | A * | 4/1998 | Kondo et al. | 428/32.27 |
| 6,110,601 | A * | 8/2000 | Shaw-Klein et al. | 428/32.25 |
| 6,419,987 | B1 | 7/2002 | Bauer et al. | |
| 6,492,005 | B1 * | 12/2002 | Ohbayashi et al. | 428/32.29 |
| 6,620,470 | B2 * | 9/2003 | Nojima et al. | 428/32.34 |
| 6,720,043 | B1 * | 4/2004 | Sismondi et al. | 428/32.27 |
| 2005/0237369 | A1 * | 10/2005 | Kosaka | 347/100 |

FOREIGN PATENT DOCUMENTS

| | | | |
|---|---|---|---|
| EP | 0 976 571 | A1 | 2/2000 |
| EP | 1 020 300 | A1 | 7/2000 |
| EP | 0 875 393 | B1 | 11/2001 |
| EP | 1 162 076 | B1 | 9/2002 |
| JP | 1995104161 | A | 4/1995 |
| JP | 1995104162 | A | 4/1995 |
| JP | 96104057 | A | 4/1996 |
| JP | 09-164758 | * | 6/1997 |
| WO | 2004/110776 | | 12/2004 |
| WO | 2005/016655 | | 2/2005 |
| WO | 2005/032837 | | 4/2005 |

OTHER PUBLICATIONS

Imaging Science Journal, 2000, vol. 48, pp. 193-198.

* cited by examiner

*Primary Examiner* — Bruce H Hess
(74) *Attorney, Agent, or Firm* — Lynne M. Blank; Andrew J. Anderson

(57) ABSTRACT

The present invention relates to a material intended for forming images by inkjet printing having good stability to ozone and to light as well as a uniform surface, to obtain a high-quality printed image. The material comprises a support and at least one ink-receiving layer, wherein the ink-receiving layer comprises at least one polysaccharide, such as carrageenan, and at least one hydriphillic polymer having hydroxyl groups, such as polyvinyl alcohol and guar gum, and inorganic particles having a neutral or positive surface charge.

15 Claims, 3 Drawing Sheets

MATERIAL FOR FORMING IMAGES BY INKJET PRINTING

CROSS REFERENCE TO RELATED APPLICATIONS

Reference is made to commonly assigned, U.S. Patent Applications:

Ser. No. 11/349,375 by Didier Martin filed of even date herewith entitled "COATING METHOD OF MATERIAL FOR INKJET PRINTING" now abandoned;

Ser. No. 11/348,767 by Didier Martin filed of even date herewith entitled "POLYSACCHARIDE MATERIALS WITH HYDROXYLATED POLYMERS IN INK RECEIVING MEDIA" now abandoned; and Ser. No. 11/348,652 by Didier Martin filed of even date herewith entitled "MATERIAL FOR FORMING IMAGES BY INKJET PRINTING" now abandoned; and Ser. No. 11/348,672 by Didier Martin filed of even date herewith entitled "GELS OF POLYSACCHARIDE, FLUORINATED SURFACTANT AND PARTICLES" now abandoned, the disclosures of which are incorporated herein by reference.

FIELD OF THE INVENTION

The present invention relates to a material intended for forming images by inkjet printing.

BACKGROUND OF THE INVENTION

Digital photography has been growing fast for several years and the general public now has access to efficient and reasonably-priced digital cameras. Therefore people are seeking to be able to produce photographic prints from a simple computer and its printer, with the best possible quality.

Many printers, especially those linked to personal office automation, use the inkjet printing technique. There are two major families of inkjet printing techniques: continuous jet and drop-on-demand.

Continuous jet is the simpler system. Pressurized ink ($3.10^5$ Pa) is forced through one or more nozzles so that the ink is transformed into a flow of droplets. In order to obtain the most regular sizes and spacing between drops, regular pressure pulses are sent using, for example, a piezoelectric crystal in contact with the ink with high frequency (up to 1 MHz) alternating current (AC) power supply. So that a message can be printed using a single nozzle, every drop must be individually controlled and directed. Electrostatic energy is used for this purpose: an electrode is placed around the ink jet at the place where drops form. The jet is charged by induction and every drop henceforth carries a charge whose value depends on the applied voltage. The drops then pass between two deflecting plates charged with the opposite sign and then follow a given direction, the amplitude of the movement being proportional to the charge carried by each of the plates. To prevent other drops from reaching the paper, they are left uncharged: so, instead of going to the support they continue their path without being deflected and go directly into a container. The ink is then filtered and can be reused.

The other category of inkjet printer is drop-on-demand (DOD). This constitutes the basis of inkjet printers used in office automation. With this method, the pressure in the ink cartridge is not maintained constant but is applied when a character has to be formed. In one widely used system, there is a row of twelve open nozzles, each of them being activated with a piezoelectric crystal. The ink contained in the head is given a pulse: the piezo element contracts with an electric voltage, which causes a decrease of volume, leading to the expulsion of the drop by the nozzle. When the element resumes its initial shape, it pumps the ink necessary for new printings into the reservoir. The row of nozzles is thus used to generate a column matrix, so that no deflection of the drop is necessary. One variation of this system replaces the piezoelectric crystals by small heating elements behind each nozzle. The drops are ejected following the forming of bubbles of solvent vapor. The volume increase enables the expulsion of the drop. Finally, there is a pulsed inkjet system in which the ink is solid at ambient temperature. The print head thus has to be heated so that the ink liquefies and can print. This enables rapid drying on a wider range of products than conventional systems.

New "inkjet" printers capable of producing photographic images of excellent quality are now available. However, they cannot supply good proofs if inferior quality printing paper is used. The choice of printing paper is fundamental for the quality of the resulting image. The printing paper must combine the following properties: high-quality printed image, rapid drying during printing, good image colorfastness over time, and smooth and glossy appearance.

In general, the printing paper comprises a support coated with one or more layers according to the properties required. It is possible, for example, to apply on a support an etch primer layer, an absorbent layer, an ink dye fixing layer and a protective layer or surface layer to provide the glossiness of the material. The absorbent layer absorbs the liquid part of the water-based ink composition after creation of the image. Elimination of the liquid reduces the risk of ink migration to the surface. The ink dye fixing layer prevents any dye loss into the fibers of the paper base, to obtain good color saturation while preventing excess ink that would encourage the increase in size of the printing dots and therefore reduce image quality. The absorbent layer and fixing layer can also constitute a single ink-receiving layer accomplishing both functions. The protective layer is designed to ensure protection against fingerprints and the pressure marks of the printer feed rollers.

The ink-receiving layer usually comprises a binder, a receiving agent and various additives. The purpose of the receiving agent is to fix the dyes in the printing paper. The best-known inorganic receivers are colloidal silica or boehmite. For example, the European Patent Applications EP-A-976,571 and EP-A-1,162,076 describe materials for inkjet printing in which the ink-receiving layer contains as inorganic receivers Ludox™ CL (colloidal silica) marketed by Grace Corporation or Dispal™ (colloidal boehmite) marketed by Sasol. However, printing paper comprising an ink-receiving layer containing such inorganic receivers can have poor image stability in time, which is demonstrated by a loss of color density.

Furthermore, polyvinyl alcohol is generally used as binder. As this binder does not ensure the adhesion of the ink-receiving layer to the support, the combination of poly(alcohol) with hardeners, such as DHD (dihydroxydioxane) or sodium tetraborate (borax) is well known, especially in U.S. Pat. No. 6,419,987. The disadvantage of this combination is that it causes crackle or wavelet phenomena during the drying of the composition intended to form the ink-receiving layer. These phenomena can visibly alter the final quality of the printed image. The use of polyvinyl alcohol thus requires specific coating conditions that do not enable either cost reductions or productivity increases. Furthermore, hardeners can lead to unwanted reactions that result in a residual tint of the ink-receiving layer. Hardeners also tend to migrate, which can cause crosslinking in the surface of the ink-receiving layer, thus obstructing ink absorption.

PROBLEM TO BE SOLVED

There remains a need for a new material intended for inkjet printing having the properties as defined above and more particularly high drying speed, good image colorfastness over time, demonstrated in particular by good stability of the printed image colors to ozone and light, and a uniform satin or gloss appearance.

SUMMARY OF THE INVENTION

Therefore, the new material intended for forming images by inkjet printing, comprising a support and at least one ink-receiving layer, wherein the at least one ink-receiving layer comprises at least one polysaccharide, at least one hydrophilic polymer comprising hydroxyl groups, and inorganic particles having a neutral or positive surface charge. The present invention also relates to a material intended for forming images by inkjet printing, comprising a support and at least one ink-receiving layer, wherein the at least one ink-receiving layer comprises at least one carrageenan, polyvinyl alcohol, guar gum, and inorganic particles having a neutral or positive surface charge

ADVANTAGEOUS EFFECT OF THE INVENTION

The present invention is intended to meet the new needs of the market in terms of photographic quality, printing speed and color stability as defined above and more particularly high drying speed, good image colorfastness over time, demonstrated in particular by good stability of the printed image colors to ozone and light, and a uniform satin or gloss appearance. The use of the carrageenan, polyvinyl alcohol and guar gum composition in a material intended for the forming images by inkjet printing enables an ink-receiving layer to be obtained having great uniformity by its fast setting, while giving it a low enough viscosity at the coating temperature to spread in the coating device and, thus, a high-quality printed image. The setting of the composition intended to form the ink-receiving layer before its drying enables an ink-receiving layer having great surface uniformity to be obtained. Furthermore, the use of this carrageenan, poly vinyl alcohol and guar gum composition enables the quantity of binder used to be reduced while retaining the material's mechanical properties. The material has good adhesion properties between the receiving layer and the support, making it no longer necessary to use hardeners. The material can be used for any type of inkjet printer as well as for all the inks developed for this technology.

DETAILED DESCRIPTION OF THE INVENTION

Figure 1:
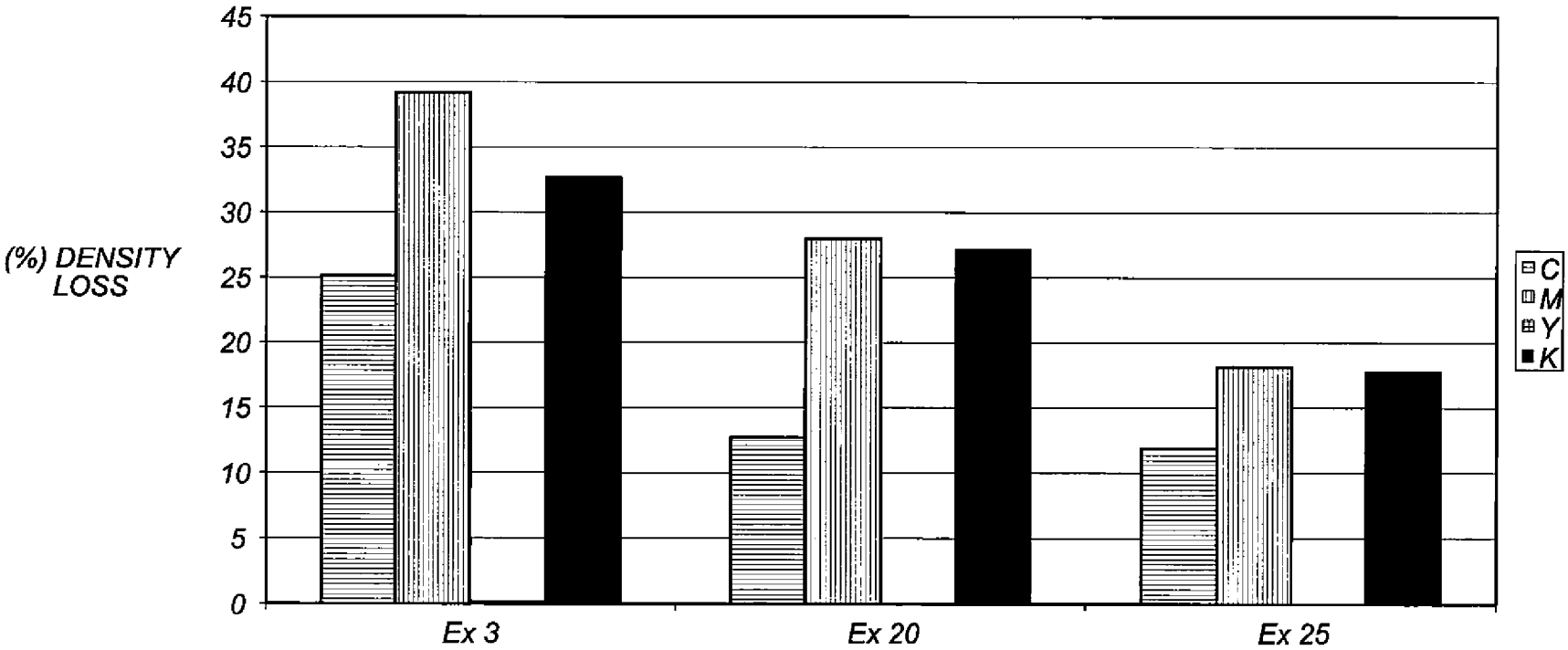
FIGS. 1 and 2 represent the percentage of color density loss for various comparative materials and according to the present invention exposed to ozone.

To meet the new needs of the market in terms of photographic quality, printing speed and color stability, it is thus necessary to propose a new material intended for inkjet printing having the properties as defined above and more particularly high drying speed, good image colorfastness over time, demonstrated in particular by good stability of the printed image colors to ozone and light, and a uniform satin or gloss appearance. The new material for use in inkjet printing, comprises a support and at least one ink-receiving layer which contains a combination of at least one hydrophilic polysaccharide, most preferably carrageenan, and hydrophilic polymer comprising hydroxyl groups, most preferably a combination of polyvinyl alcohol, and guar gum, and inorganic particles having a neutral or positive surface charge.

Preferably, the carrageenan is a κ-carrageenan. The use of the carrageenan, polyvinyl alcohol and guar gum composition in a material intended for the forming images by inkjet printing enables a hydrophillic ink-receiving layer to be obtained having great uniformity by its fast setting, and thus a high-quality printed image. Furthermore, the use of this carrageenan, polyvinyl alcohol and guar gum composition enables the quantity of binder used to be reduced while retaining the material's mechanical properties.

The material intended for forming images by inkjet printing according to the present invention comprises firstly a support. This support is selected according to the desired use. It can be a transparent or opaque thermoplastic film, in particular a polyester base film such as polyethylene terephthalate; cellulose derivatives, such as cellulose ester, cellulose triacetate, cellulose diacetate; polyacrylates; polyimides; polyamides; polycarbonates; polystyrenes; polyolefines; polysulfones; polyetherimides; vinyl polymers such as polyvinyl chloride; and their mixtures. The support used in the invention can also be paper, both sides of which may be covered with a polyethylene layer. When the support comprising the paper pulp is coated on both sides with polyethylene, it is called Resin Coated Paper (RC Paper) and is marketed under various brand names. This type of support is especially preferred to constitute a material intended for inkjet printing. The side of the support that is used can be coated with a very thin layer of gelatin or another composition to ensure the adhesion of the first receiving layer on the support. To improve the adhesion of the adhesion layer (layer of gelatin or other composition) on the support, the support surface can also have been subjected to a preliminary treatment by corona discharge before applying the adhesion layer.

Carrageenan typically made from dried extracts of red seaweed (rhodophyceae). Carrageenans are linear polysaccharides made up of more or less substituted galactose residues. The chain is made up of subunits called carrabioses comprising two galactose residues bound by a β (1-4) linkage. These carrabioses are bound together in the chain by α (1-3) linkages. Furthermore, the galactose residues are either esterified by sulfuric acid, or have an oxygen bridge between carbons 3 and 6. Carrageenans are polymers made up of more than 1000 galactose residues. There are three main types of carrabiose: κ (kappa)-carrabiose, ι (iota)-carrabiose, and λ (lambda)-carrabiose, corresponding to the three main types of carrageenans: κ-carrageenan, a polysaccharide made up of n units of κ-carrabiose, ι-carrageenan, a polysaccharide made up of n units of ι-carrabiose, and λ-carrageenan, a polysaccharide made up of n units of λ-carrabiose.

According to the present invention, the carrageenan is selected from among the group comprising the κ-carrageenans, the ι-carrageenans or a combination of these compounds. Preferably, the carrageenan comprises at least 80% κ-carrageenan. According to an especially preferred variant, carrageenan is a pure κ-carrageenan. Carrageenan acts as a gelating agent enabling thermoreversible gelation of the composition intended to form the ink-receiving layer.

According to the invention, the ink-receiving layer comprises at least one polymer comprising hydroxyl groups. The polymer is most desirably water soluble and/or hydrophillic. Preferably, the polymer comprising the hydroxyl groups is selected from among the group including polyvinyl alcohol and guar gum, or a mixture of these polymers. Polyvinyl alcohol is used as binder and guar gum is used as co-binder. Guar gum enables the phenomena of syneresis and the rheological characteristics of the material to be controlled, and enables the viscosity of the composition intended to form the ink-receiving layer to be reduced. Polyvinyl alcohol enables the gel strength to be increased, the syneresis phenomena to be reduced in synergy with the guar gum, in order to obtain good mechanical properties such as adhesion and absence of crackle, and a glossy appearance. Preferably, polyvinyl alcohol has molecular weight greater than 55,000, and preferably greater than 100,000.

The ink-receiving layer preferably includes less than 1% by weight of polysaccharide, such as carrageenan, compared with the total weight of the wet receiving layer. Preferably, the quantity of polysaccharide, such as carrageenan, is between 0.05% and 0.7% by weight compared with the total weight of the wet receiving layer. Preferably, the quantity of polysaccharide, such as carrageenan, is between 0.05% and 0.12% by weight compared with the total weight of the wet receiving layer. Preferably, the weight ratio of the guar gum to polysaccharide, such as carrageenan, is between 1:20 and 1:5, and preferably between 1:10 and 1:5. The quantity of polysaccharide, such as carrageenan, in the ink-receiving layer may be from 0.1 to 3% by weight, preferably, from 0.15 to 2% by weight and, most preferably, from 0.15 to 0.4% by weight of the receiving layer.

Preferably, the ink-receiving layer comprises between 0.3% and 5% by weight of polyvinyl alcohol, and preferably, between 1% and 3% by weight compared with the total weight of the wet receiving layer. The quantity of hydrophilic polymer comprising hydroxyl groups, such as polyvinyl alcohol, in the ink-receiving layer may be from 0.5 to 20% by weight, preferably, from 1 to 15% by weight and, most preferably, from 3 to 10% by weight of the receiving layer Preferably, the ink-receiving layer comprises less than 40% by weight, and preferably between 13% and 33% by weight of inorganic particles compared with the total weight of the wet receiving layer. The quantity of particles in the ink-receiving layer may be from 80 to 99 by weight, preferably, from 85 to 99% by weight and, most preferably, from 90 to 97% by weight of the receiving layer Preferably the inorganic particles are porous. As the inorganic particles have a neutral surface charge, they can be calcium carbonate and barium sulfate. Inorganic particles, sometimes referred to as fillers, having a positive surface charge can be zinc oxides, aluminas, zeolites, aluminosilicates, and modified silicas.

The material intended for forming images by inkjet printing according to the invention can comprise, besides the ink-receiving layer described above, other layers having other functions, arranged above or below said ink-receiving layer. The ink-receiving layer as well as the other layers can comprise any other additives known to those skilled in the art to improve the properties of the resulting image, such as, for example, UV ray absorbers, optical brightening agents, antioxidants, and plasticizers.

The composition of the coating intended to form the ink-receiving layer is produced by mixing the inorganic particles, water, carrageenan and guar gum with heating. Then, polyvinyl alcohol is added and the composition is stirred to obtain a uniform solution. The composition can also comprise a surfactant to improve its coating properties. The composition is coated on the support according to any appropriate coating method, such as blade, knife, curtain or meniscus coating. The composition is applied with a thickness between approximately 200 μm and 400 μm in the wet state. The composition forming the ink-receiving layer can be applied to both sides of the support. It is also possible to provide an antistatic or anti-roll layer on the back of the support coated with the ink-receiving layer.

The resulting material is then cooled to obtain gelation of the composition coated on the support. Preferably, cooling takes place immediately after the coating step and causes the immediate gelation of the composition coated on the support intended to form the ink-receiving layer.

Then, the resulting material is dried. Because of the gelation and the setting of the composition intended to form the ink-receiving layer, the material can be dried in a dryer in which the supports run vertically (loop dryer), which enables the drying speed to be increased, and thus productivity.

The use of combination of carrageenan, polyvinyl alcohol and guar gum enables the composition intended to form the ink-receiving layer to be fixed quickly on the support after coating, while giving it a low enough viscosity at the coating temperature to spread in the coating device. Furthermore, the setting of the composition intended to form the ink-receiving layer before its drying enables an ink-receiving layer having great surface uniformity to be obtained. The printed image is thus high-quality. As the material according to the invention has good adhesion properties between the receiving layer and the support, it is no longer necessary to use hardeners. The combination of carrageenan, polyvinyl alcohol and guar gum advantageously enables replacement of the gelatin generally used as binder in the ink-receiving layers of inkjet printing paper and which has the disadvantage of swelling in contact with ink drops. The material intended for forming inkjet-printing images according to the invention has good colorfastness over time. It can be used for any type of inkjet printer as well as for all the inks developed for this technology.

EXAMPLES

The following examples illustrate the present invention without however limiting its scope.

1) Preparing Compositions Intended to be Coated on a Support to Constitute an Ink-receiving Layer Unless otherwise stated, all the percentages given are by weight.

Composition 1:

The inorganic particle used was an alumina Pural® 200 (boehmite) marketed by SASOL, having a specific surface of 110 $m^2/g$. Polyvinyl alcohol (PVA) Gohsenol GH23 marketed by Nippon Goshei in 9% solution was used as binder. Zonyl® FSN marketed by Dupont™ in 40% aqueous solution was used as surfactant.

Composition 1 contained:

Deionized water=24.2 g

Pural® 200=40 g

PVA GH23=33.3 g

Zonyl®FSN=2.5 g

Composition 1 contained 40% particle, 3% PVA.

The mixture of the inorganic particle with the PVA was stirred vigorously and heated to 60° C. This composition 1, having a very high quantity of inorganic particles, formed a gel as it cooled to ambient temperature (25° C.).

Composition 2:

Composition 1 was repeated but only using 33% of inorganic particles. No gel formation was observed.

Composition 3:

The porous inorganic particle used was alumina Pural® 200. Polyvinyl alcohol (PVA) Gohsenol GH17 marketed by Nippon Goshei in 9% solution was used as binder. 10 G marketed by Olin in 20% aqueous solution was used as surfactant. 1,4-dioxane-2,3-diol (DOD) (ref. 256242) and boric acid (ref. 202878) supplied by ALDRICH were used as hardeners.

Composition 3 contained:

Deionized water=32.27 g

Pural® 200=33 g

PVA GH17=32 g

DOD=0.18

Boric acid=0.05 g

10 G=2.5 g

Composition 3 contained 33% particle, 2.88% PVA.

The mixture of the inorganic particle with the PVA was stirred vigorously and heated to 60° C. The other compounds were then added in the above order.

Composition 4:

Composition 4 corresponded to composition 3 kept for 12 hours at 8° C. and heated to 60° C.

Composition 5:

Pure κ-carrageenan Satiagel™ ME5 marketed by Degussa in 1% aqueous solution was used. This solution was prepared by mixing the carrageenan powder in hot deionized water (80° C.) with vigorous stirring. Composition 5 contained 32.9% of Pural®200, 0.2% of Satiagel™ ME5, 2.5% of 10 G and 64.4% of water.

The inorganic particle was dissolved in deionized water with magnetic stirring at ambient temperature. Then, the mixture was heated to 80° C. with steady stirring. The solution of Satiagel™ ME5 was added. Deionized water was added to make up to 100 g. The mixture was heated to 50° C. and stirred for 30 minutes at 8000 rpm.

Composition 6:

Composition 5 was repeated but with only 0.15% of Satiagel™ ME5.

Composition 7:

Composition 5 was repeated but with only 0.12% of Satiagel™ ME5.

Composition 8:

Composition 5 was repeated but with only 0.1% of Satiagel™ ME5.

Composition 9:

Composition 5 was repeated but with only 0.05% of Satiagel™ ME5.

Composition 10:

Pure κ-carrageenan Satiagel™ ME5 and polyvinyl alcohol GH17 were used. Composition 10 contained 32.9% of Pural® 200, 0.12% of Satiagel™ ME5, 3% of PVA, 2.5% of 10 G and 61.48% of water.

Composition 11:

Composition 10 was repeated but according to the following percentages: 32.9% of Pural® 200, 0.12% of Satiagel™ ME5, 1% of PVA, 2.5% of 10 G and 63.48% of water.

Composition 12:

Guar gum Viscogum™ BCR 13/80 marketed by Degussa in 1% aqueous solution was used. Composition 12 contained 32.9% of Pural® 200, 0.12% of Satiagel™ ME5, 0.012% of Viscogum, 2.5% of 10 G and 64.47% of water.

Composition 13:

Composition 12 was repeated but with the following percentages: 32.9% of Pural® 200, 0.10% of Satiagel™ ME5, 0.01% of Viscogum, 2.5% of 10 G and 64.49% of water.

Composition 14:

Composition 12 was repeated but with the following percentages: 32.9% of Pural® 200, 0.05% of Satiagel™ ME5, 0.05% of Viscogum, 2.5% of 10 G and 64.54% of water.

Composition 15:

The PVA was replaced by polystyrene sodium sulfonate (PSS) supplied by Alco Chemical. Composition 15 contained:

32.9% of Pural® 200, 0.12% of Satiagel™ ME5, 3% of PSS, 2.5% of 10 G and 61.48% of water.

Composition 16:

Composition 15 was repeated with the following percentages: 32.9% of Pural® 200, 0.10% of Satiagel™ ME5, 1% of PSS, 2.5% of 10 G and 63.5% of water.

Composition 17:

The PVA was replaced by a copolymer acrylamide (20%) and 2-acrylamido-2-methyl propanesulfonate (80%) (AAMPS), supplied by Eastman Chemical. Composition 17 contained: 32.9% of Pural® 200, 0.12% of Satiagel™ ME5, 3% of AAMPS, 2.5% of 10 G and 64.47% of water.

Composition 18:

Composition 17 was repeated with the following percentages: 32.9% of Pural® 200, 0.10% of Satiagel™ ME5, 1% of AAMPS, 2.5% of 10 G and 64.49% of water.

Composition 19:

Pural® 200 was used with a composition of pure κ-carrageenan Satiagel™ ME5, PVA GH 23 and Viscogum. PVA GH 23 has a molecular weight greater than 100,000. The inorganic particle was dissolved in deionized water with magnetic stirring at ambient temperature. Then the mixture was heated to 80° C. with steady stirring. The carrageenan and the Viscogum were added, and then the PVA. Composition 19 contained 32.9% of Pural® 200, 0.05% of Satiagel™ ME5, 0.005% of Viscogum, 0.3% of PVA, 2.5% of 10 G and 64.24% of water.

Composition 20:

Composition 19 was repeated with 1.2% of PVA.

Composition 21:

Composition 19 was repeated with 1.8% of PVA.

Composition 22:

Composition 19 was repeated with 3% of PVA.

Composition 23:

Composition 19 was repeated with 5% of PVA.

Composition 24:

Composition 20 was repeated by replacing pure κ-carrageenan Satiagel™ ME5 by Satiagel™ AMP 45, combination of κ-carrageenan and ι-carrageenan (approx. 95/5).

Composition 25:

Composition 20 was repeated by replacing pure κcarrageenan Satiagel™ ME5 by a pure ι-carrageenan, Satiagel™ SIA.

Composition 26:

Calcium carbonate, supplied by Prolabo (ref. 22291.366) was used as porous inorganic particle. Composition 26 contained 32.9% of calcium carbonate, 0.05% of Satiagel™ AMP45, 0.005% of Viscogum, 0.9% of PVA, 2.5% of 10 G and 63.64% of water.

Composition 27:

Zeolite (8-12 mesh) supplied by Aldrich (ref. 208582) was used as porous inorganic particle. Composition 27 contained 15% of zeolite, 0.7% of Satiagel™ ME5, 0.07% of Viscogum, 1.5% of PVA, 2.5% of 10 G and 80.23% of water.

2) Preparing Materials Intended for Forming Images by Inkjet Printing

A Resin Coated Paper type support, previously coated with a very thin gelatin layer, was placed on a coating machine and held on the machine by vacuum. This support was coated with a composition as prepared according to section 1 and previously heated to 50° C. using a bar with a wet thickness of 200 μm. The coating conditions are given in Table I below:

TABLE I

| Parameters | Values |
|---|---|
| Coating speed | 0.3 $ms^{-1}$ |
| Wet thickness | 200 μm |
| Coated area | 630 $cm^2$ |
| Setting temperature | 15° C. |
| Volume of coated composition | 20 ml |
| Temperature of the composition | 50° C. |

The resulting materials correspond to the examples shown in Table II below giving the composition used to realize the ink-receiving layer:

The characteristics of the coated ink-receiving layer were observed. Also measured was the gloss of the resulting materials using a Picogloss 560 glossmeter marketed by Erichsen.

TABLE II

| Example | Composition | Characteristics of the coated ink-receiving layer | Gloss (60°) |
|---|---|---|---|
| 1 (comp.) | 1 | Uneven coating, rapid setting, reduced adhesion, crackles | 37 |
| 2 (comp.) | 2 | Uneven coating, no setting, crackle | 47 |
| 3 (comp.) | 3 | Uniform coating, light setting, good adhesion | 30 |
| 4 (comp.) | 4 | Uneven coating, too thick, reduced adhesion | — |
| 5 (comp.) | 5 | Pasty mixture, uneven coating | — |
| 6 (comp.) | 6 | Pasty mixture, uneven coating | 35 |
| 7 (comp.) | 7 | Viscous mixture, light traces | 55 |
| 8 (comp.) | 8 | Uniform coating, low adhesion, crackle | 29 |
| 9 (comp.) | 9 | Uniform coating, low adhesion, crackle | 88 |
| 10 (comp.) | 10 | Low uniformity, pasty mixture | mat |
| 11 (comp.) | 11 | Good coating but presence of traces, significant setting, no crackle | mat |
| 12 (comp.) | 12 | Good coating but presence of numerous traces, medium setting | mat |
| 13 (comp.) | 13 | Good coating but presence of numerous traces, medium setting | mat |
| 14 (comp.) | 14 | Uniform coating, no fault, low setting | satin |
| 15 (comp.) | 15 | Pasty uneven mixture, uneven coating, no adhesion | — |
| 16 (comp.) | 16 | Pasty uneven mixture, uneven coating, no adhesion | — |
| 17 (comp.) | 17 | Pasty uneven mixture, uneven coating, no adhesion | — |
| 18 (comp.) | 18 | Pasty uneven mixture, uneven coating, no adhesion | — |
| 19 (inv.) | 19 | Uniform coating, no fault, significant setting, very good adhesion | 18 |
| 20 (inv.) | 20 | Uniform coating, no fault, significant setting, very good adhesion | 20 |
| 21 (inv.) | 21 | Uniform coating, no fault, significant setting, very good adhesion | 20 |
| 22 (inv.) | 22 | Uniform coating, no fault, significant setting, very good adhesion | 20 |
| 23 (inv.) | 23 | Uniform coating, no fault, significant setting, very good adhesion | 20 |
| 24 (inv.) | 24 | Uniform coating, no fault, significant setting, very good adhesion | 19 |
| 25 (inv.) | 25 | Uniform coating, no fault, significant setting, very good adhesion | 15 |
| 26 (inv.) | 26 | Uniform coating, no fault, significant setting, very good adhesion | 2 |
| 27 (inv.) | 27 | Uniform coating, no fault, significant setting, very good adhesion | 2 |

The results of Table II above show that the inorganic particle used only with the PVA (Examples 1 and 2) only obtains a low-quality uneven coating with the appearance of traces due to particle aggregation for Example 1 or with the appearance of marbling due to the lack of setting for Example 2.

Example 3 with the hardeners gives light setting, but Example 4, giving bad coating, shows that the hardeners cannot be kept.

Examples 5 to 9 show that when carrageenan is used alone with inorganic particles, the ink-receiving layer has numerous faults when the percentage of carrageenan is greater than 0.1% (Examples 5 to 7). Besides, for a carrageenan percentage between 0.05% and 1% (Examples 8 and 9), the coated composition does not set. These examples clearly show the synergy of the carrageenan, PVA and guar gum composition.

Examples 10 to 14 show that the simple combination of carrageenan and PVA or of carrageenan and guar gum does not obtain enough setting and uniform good quality coating.

Examples 15 to 18 show that the tested polymers (PPS and AAMPS) are weakly compatible with the matrix of carrageenan and inorganic particles, and give a coated layer having low mechanical properties (no adhesion, delamination).

Examples 20 to 24, in accordance with the present invention, show that the combination of carrageenan, PVA and guar gum obtains uniform coating, without fault, significant setting, and very good adhesion of the layer on the support, when the layer contains inorganic particles. Thus the material can be dried in loop driers.

The guar gum gives a light gel and lowers the viscosity while the PVA reinforces gel formation and setting capacity. The presence of PVA is also necessary to obtain a layer with good mechanical properties (adhesion). The PVA enables strong interaction with the carrageenan reducing interactions between the carrageenan and the inorganic particles. The percentage of PVA has no influence on gloss.

The addition of guar gum enables the quantity of PVA to be increased by limiting the viscosity increase. The use of guar gum is thus necessary to maintain the viscosity of the combination of inorganic particles and carrageenan and PVA at a low level. The guar gum also enables a good printing quality to be guaranteed.

Examples 20, 24 and 25 show that pure κ-carrageenan, the combination of κ-carrageenan and ι-carrageenan and pure ι-carrageenan enable very good quality coating layers to be obtained. An increase of viscosity is observed when the proportion of ι-carrageenan is increased. Preferably, a quantity of κ-carrageenan greater than 90% is used to reduce the combination's viscosity and to coat the composition on the support more easily. Increasing the content of ι-carrageenan also causes a reduction of gloss.

Examples 26 and 27 show that the boehmite can be replaced by other inorganic particles, such as calcium carbonate (neutral surface charge) or zeolite (positive surface charge).

3) Evaluating the Printing Properties

Test charts were printed on some of the resulting materials using inkjet printers, HP Deskjet 5550 and Epson 890, and their related inks. The printing properties evaluated were drying speed, image definition, faults such as the formation of stripes, lateral spread of the dye and ink coalescence.

The drying speed was measured just after the printing of a tested material, using a sheet of paper (size A4, basis weight 80 g), which is directly applied to the printed material. A roller (weight 2 kg, L=18.5 cm, ϕ=4 cm) was applied to the sheet of paper. A qualitative assessment of the degree of color transfer on the sheet of paper was made:

Image definition (Def) was assessed according to three degrees: High=perfect reproduction of the image elements, Medium=slight degradation of the image based on the phenomenon of lateral dye spread (low to medium) or coalescence (low to high), Low=significant degradation of the image due to disturbed colors (significant lateral dye spread, significant dispersion). The results are given in Table III below:

TABLE III

| Example | HP5550 | Epson 890 |
|---|---|---|
| 1 (comp.) | Good definition, instantaneous drying, no coalescence or lateral spread | Medium definition, coalescence, lateral spread, appearance of stripes |
| 2 (comp.) | Good definition, instantaneous drying, no coalescence or lateral spread | Low definition, very significant coalescence and lateral spread, stripes, no instantaneous drying |
| 20 (inv.) | Good definition, instantaneous drying, no coalescence or lateral spread | Good definition, instantaneous drying, no coalescence or lateral spread |
| 24 (inv.) | Good definition, instantaneous drying, no coalescence or lateral spread | Good definition, instantaneous drying, no coalescence or lateral spread |
| 25 (inv.) | Good definition, instantaneous drying, no coalescence or lateral spread | Good definition, instantaneous drying, no coalescence or lateral spread |
| 26 (inv.) | Good definition, instantaneous drying, no coalescence or lateral spread | Good definition, instantaneous drying, no coalescence or lateral spread |
| 27 (inv.) | Good definition, instantaneous drying, no coalescence or lateral spread | Good definition, instantaneous drying, no coalescence or lateral spread |

The results of Table III show that only the materials of the invention comprising inorganic particles together with the combination of carrageenan, PVA and guar gum have good printing properties whatever printer is used.

4) Evaluating Colorfastness Over Time

To evaluate colorfastness over time, a color alteration test by exposure to ozone was performed for some of the resulting materials. Test charts, comprising four colors (black, yellow, cyan and magenta), were printed on each material using an HP 5550 printer and an Epson 890 printer and their related inks.

The test charts were analyzed using a GretagMacbeth Spectrolino densitometer that measures the strength of the various colors. Then, the materials were placed in the dark in a room with controlled ozone atmosphere (60 ppb) for three weeks. Each week, any degradation of the color density was monitored using the densitometer.

Also, for the resulting materials, a color alteration test was carried out by exposure to light of 50 Klux for two weeks. Test charts, comprising four colors (black, yellow, cyan and magenta) were printed on the resulting materials using a HP 5550 printer and the related ink. Then, the printed test charts were placed under a sheet of Plexiglas® 6 mm thick and totally transparent to the emission spectra of the neon tubes used (Osram Lumilux® FQ 80 W/ 840 Cool White), in order to minimize atmospheric oxidation phenomena. Any deterioration of the color density was measured using the densitometer after two weeks.

FIG. 1 represents the percentage of density loss observed for the maximum density for the four colors of the test chart after three weeks for examples 3, 20 and 25 printed using the HP 5550 printer and exposed to ozone. Letters K, C, M and Y represent the colors black, cyan, magenta and yellow respectively. No bar means that the density loss was 0%.

Figure 2:
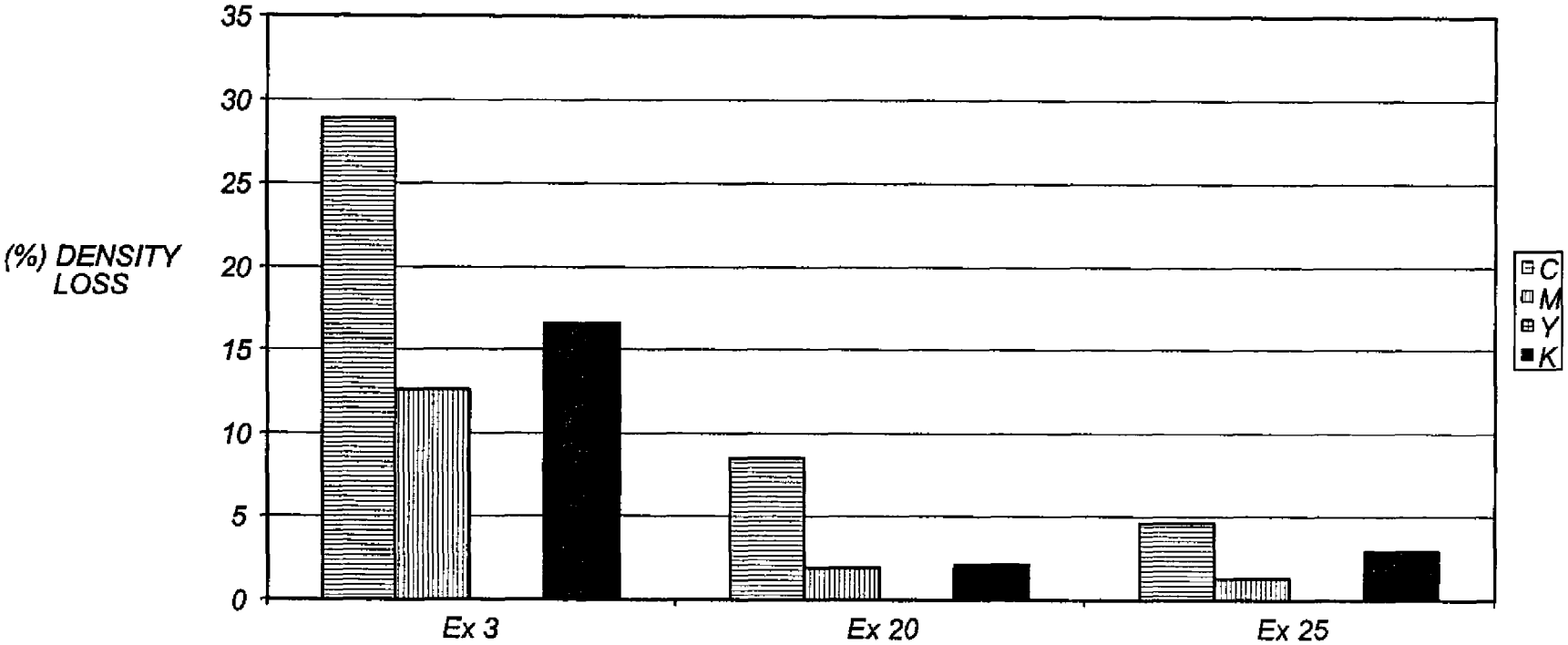

FIG. 2 represents the percentage of density loss observed for the maximum density for the four colors of the test chart after three weeks for examples 3, 20 and 25 printed using the Epson 890 printer and exposed to ozone. No bar means that the density loss was 0%.

It may be noted that the materials according to the invention (Examples 20 and 25) adding inorganic particles to the combination of carrageenan, PVA and guar gum have greater stability to ozone and thus better colorfastness than the comparative material, whichever printer is used.

Figure 3:
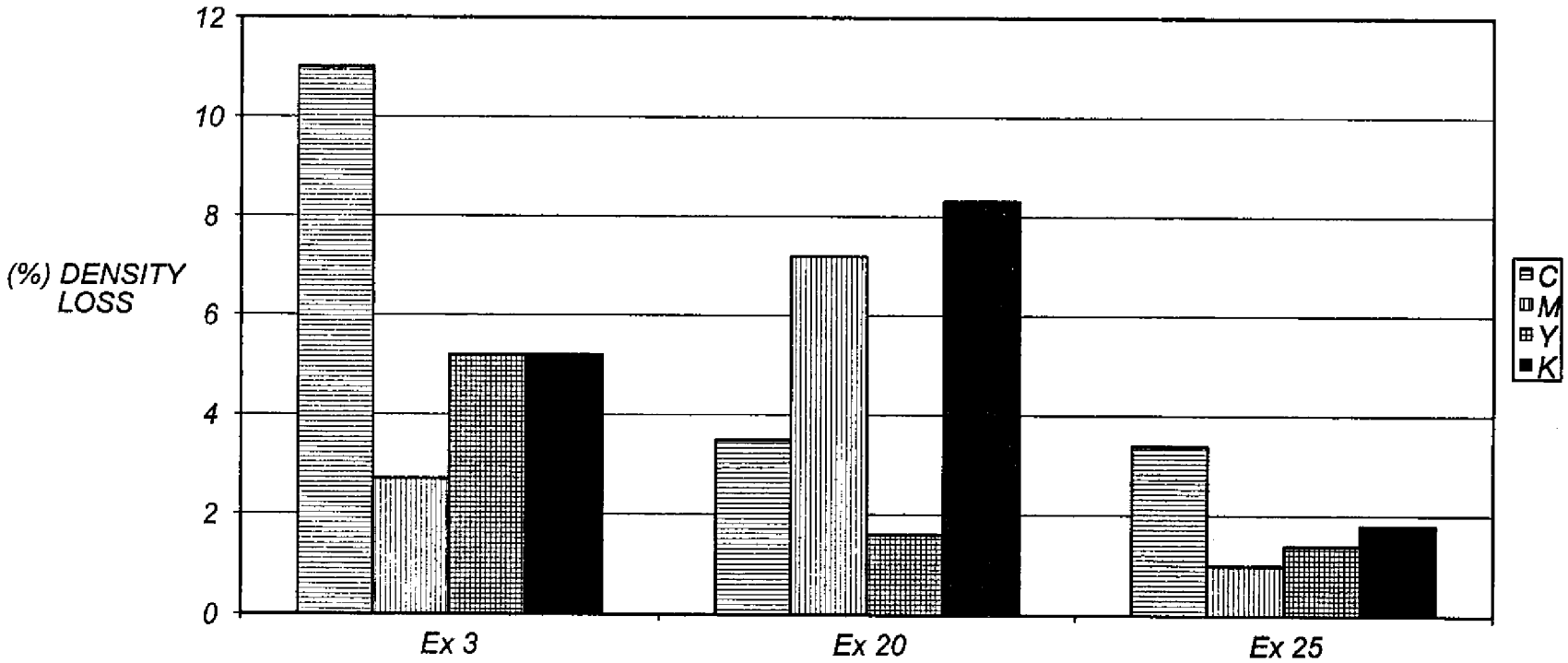
FIG. 3 represents the percentage of color density loss for various comparative materials and according to the present invention when exposed to light.

FIG. 3 represents the percentage of density loss observed for the maximum density for the four colors of the test chart after two weeks for examples 3, 20 and 25 printed using the HP 5550 printer and exposed to light.

It may be noted that the materials according to the invention (Examples 20 and 25) adding inorganic particles to the combination of carrageenan, PVA and guar gum have greater stability to light and thus better colorfastness than the comparative material.

The invention has been described in detail with particular reference to certain preferred embodiments thereof, but it will be understood that variations and modifications can be effected within the spirit and scope of the invention.

The invention claimed is:

1. A material intended for forming images by inkjet printing, comprising a support and at least one ink-receiving layer, wherein said at least one ink-receiving layer comprises carrageenan, a mixture of hydrophilic polymers comprising hydroxyl groups comprising polyvinyl alcohol and guar gum, and inorganic particles having a neutral or positive surface charge, wherein said ink-receiving layer comprises from 80 to 99% by weight of inorganic particles compared with the total weight of the ink-receiving layer.

2. The material of claim 1 wherein said carrageenan is capable of thermoreversible gelation.

3. The material of claim 1 wherein said carrageenan is at least one member selected from the group consisting of κ-carrageenan, ι-carrageenan or a combination thereof.

4. The material of claim 1 wherein said carrageenan comprises at least 80% of κ-carrageenan.

5. The material of claim 1 wherein said carrageenan is a pure κ-carrageenan.

6. The material of claim 1 wherein the weight ratio of guar gum to carrageenan is between 1:20 and 1:5.

7. The material of claim 1 wherein said ink-receiving layer comprises from 0.1 to 3% solids by weight of carrageenan.

8. The material of claim 1 wherein said ink-receiving layer comprises from 0.15 to 0.4% solids by weight of carrageenan.

9. The material of claim 1 wherein said polyvinyl alcohol has a molecular weight greater than 55,000.

10. The material of claim 1 wherein said ink-receiving layer comprises from 0.5 to 20% by weight of polymer comprising hydroxyl groups.

11. The material of claim 1 wherein said ink-receiving layer comprises from 3 to 10% by weight of polymer comprising hydroxyl groups.

12. The material of claim 1 wherein said ink-receiving layer comprises from 90 to 97% by weight of inorganic particles compared with the total weight of the receiving layer.

13. The material of claim 1 wherein said inorganic particles having a neutral surface charge comprise at least one member selected from the group consisting of calcium carbonate and barium sulfate.

14. The material of claim I wherein said inorganic particles having a positive surface charge comprise at least one member selected from the group consisting of zinc oxides, aluminas, zeolites, aluminosilicates, and modified silicas.

15. The material of claim 1, wherein the ink-receiving layer comprises from 0.5 to 15% by weight of polyvinyl alcohol and from 0.1 to 3% by weight of carrageenan, and wherein the weight ratio of guar gum to carrageenan is between 1:20 and 1:5.

* * * * *